US010559900B2

(12) United States Patent
Ito

(10) Patent No.: US 10,559,900 B2
(45) Date of Patent: Feb. 11, 2020

(54) BOARD CONNECTOR WITH TOOL INSTALLATION SPACE FOR BEDING A TERMINAL FITTING

(71) Applicant: Sumitomo Wiring Systems, Ltd., Yokkaichi, Mie (JP)

(72) Inventor: Toshihiro Ito, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/293,977

(22) Filed: Mar. 6, 2019

(65) Prior Publication Data

US 2019/0296467 A1 Sep. 26, 2019

(30) Foreign Application Priority Data

Mar. 26, 2018 (JP) ..... 2018-057450

(51) Int. Cl.

| | |
|---|---|
| ***H01R 12/00*** | (2006.01) |
| ***H01R 12/70*** | (2011.01) |
| ***H01R 43/20*** | (2006.01) |
| ***H01R 13/415*** | (2006.01) |
| ***H01R 12/58*** | (2011.01) |

(52) U.S. Cl.

CPC ..... *H01R 12/7064* (2013.01); *H01R 12/58* (2013.01); *H01R 13/415* (2013.01); *H01R 43/205* (2013.01)

(58) Field of Classification Search

CPC ..... H01R 12/00; H01R 12/724

USPC ..... 439/79, 80

See application file for complete search history.

(56) References Cited

U.S. PATENT DOCUMENTS

| | | | | |
|---|---|---|---|---|
| 7,311,546 | B2 * | 12/2007 | Itou | H01R 13/4364 439/385 |
| 9,865,949 | B2 * | 1/2018 | Kitagawa | H01R 12/58 |
| 2006/0264097 | A1 | 11/2006 | Nakano et al. | |
| 2009/0176402 | A1 * | 7/2009 | Honda | H01R 4/02 439/377 |

FOREIGN PATENT DOCUMENTS

| | | |
|---|---|---|
| JP | 2006-324189 | 11/2006 |

* cited by examiner

*Primary Examiner* — Phuong K Dinh

(74) *Attorney, Agent, or Firm* — Gerald E. Hespos; Michael J. Porco; Matthew T. Hespos

(57) ABSTRACT

A terminal fitting (20) includes a mating side connecting portion (26), a board connecting portion (27) and a bent portion (28) arranged between the board connecting portion (27) and the mating side connecting portion (26). The mating side connecting portion (26) and the board connecting portion (27) are connected substantially at a right angle via the bent portion (28). The housing (60) includes a press-fit hole (65) into which the mating side connecting portion (26) is to be press-fit, and a back surface (68) facing the board connecting portion (27). The back surface (68) of the housing (60) includes a retracted portion (71) retracted in a direction separating from the board connecting portion (27).

8 Claims, 11 Drawing Sheets

BOARD CONNECTOR WITH TOOL INSTALLATION SPACE FOR BEDING A TERMINAL FITTING

BACKGROUND

Field of the Invention

The invention relates to a board connector.

Related Art

Japanese Unexamined Patent Publication No. 2006-324189 discloses a board connector with a housing that is to be fixed to a circuit board via a fixing portion. The housing includes a terminal holding portion in the form of a back plate and a receptacle in the form of a rectangular tube projects forward of the terminal holding portion. The terminal holding portion includes terminal insertion holes for receiving terminal fittings. Each terminal fitting includes a horizontal part to be press-fit into the terminal insertion hole and a vertical part bent down via a bend behind the terminal holding portion. A front half of the horizontal part projects into the receptacle and includes a connecting portion that is connectable to a mating terminal. The vertical part includes a board-side connecting portion to be connected to a conductive path of the circuit board.

A space for installing a tool for bending the terminal fittings must be ensured behind the rear surface of the terminal holding portions. If a wall thickness of the terminal holding portion in a front-rear direction is reduced while the space for installing the tool is ensured, a length of the connector in the front-rear direction can be reduced. However, contact margins of the horizontal parts of the terminal fittings with the terminal holding portion are reduced, and holding forces for the terminal fittings may be reduced. On the other hand, the wall thickness of the terminal holding portions may be increased while the space for installing the tool is ensured to enhance the holding forces for the terminal fittings. However, the length of the connector in the front-rear direction becomes large.

The invention was completed on the basis of the above situation and aims to provide a board connector capable of securing a holding force for a terminal fitting and a space for installing a tool and avoiding enlargement of the connector.

SUMMARY

The invention is directed to a board connector with a terminal fitting including a mating side connecting portion to be connected to a mating terminal fitting, a board connecting portion to be connected to a circuit board and a bent portion between the mating side connecting portion and the board connecting portion. The mating side connecting portion and the board connecting portion are connected at a substantially right angle via the bent portion. The board connector also includes a housing with a press-fit hole into which the mating side connecting portion is press-fit, and a back surface facing the board connecting portion. The back surface of the housing includes a retracted portion retracted in a direction separating from the board connecting portion with respect to a distant side that is distant from the circuit board on a close side that is close to the circuit board.

The bent portion and the board connecting portion can be formed by bending the terminal fitting while bringing a tool into contact with the retracted portion on the back surface of the housing. The retracted portion is retracted in the direction separating from the board connecting portion with respect to the distant side on the close side that is close to the circuit board. Thus, a space for installing the tool can be ensured between the retracted portion of the housing and the board connecting portion and the enlargement of the connector can be avoided. Further, a large contact margin between the housing and the mating side connecting portion can be provided on the side distant from the circuit board across the opening of the press-fit hole. Thus, a holding force for the terminal fitting can be ensured.

The press-fit holes may be provided in plural stages arranged in a vertical direction from a side distant from the circuit board to a side close to the circuit board in the housing and the retracted portion is provided only in a part corresponding to the press-fit hole in the lowermost stage closest to the circuit board. According to this configuration, the contact margins between the housing and the terminal fittings can be ensured in parts corresponding to the press-fit holes except those in the lowermost stage.

The back surface of the housing may include an inclined guiding portion capable of guiding the mating side connecting portion on a peripheral part of the opening of the press-fit hole. The retracted portion may be shaped to cut an inclined part of the guiding portion. The retracted portion is not formed by cutting the entire guiding portion. Thus, a guiding function of the guiding portion can be exhibited. Further, a formation range of the retracted portion can be made smaller, and a holding force can be ensured also for the terminal fitting inserted in the press-fit hole in the lowermost stage.

A part of the guiding portion on a side close to the circuit board with respect to the press-fit hole and provided with the retracted portion may have a sloped portion with a larger angle of inclination with respect to a press-fitting direction of the mating side connecting portion than a part on a side distant from the circuit board across the press-fit hole. According to this configuration, the guiding function of the guiding portion can be exhibited without any trouble on the side of the retracted portion for the terminal fitting press-fit in the press-fit hole corresponding to the retracted portion.

The mating side connecting portion includes a protruding piece protruding to be lockable to an inner surface of the press-fit hole. A tip of the protruding piece is a fracture surface. Additionally, the protruding piece may be located inside at least one of the press-fit hole and the guiding portion. For example, in the case of manufacturing a terminal fitting by cutting a carrier of chained terminals, a tip of a protruding piece is a fracture surface and burrs may be formed on the peripheral edge of the fracture surface. At this time, if the protruding piece protrudes from the press-fit hole or the guiding portion of the housing, the burrs may drop onto the circuit board and a short circuit may occur via the burrs. The protruding piece is located inside the press-fit hole or the guiding portion according to this configuration. Therefore, the drop of the burrs onto the circuit board can be prevented and the occurrence of a short circuit can be avoided.

DETAILED DESCRIPTION

Figure 4:
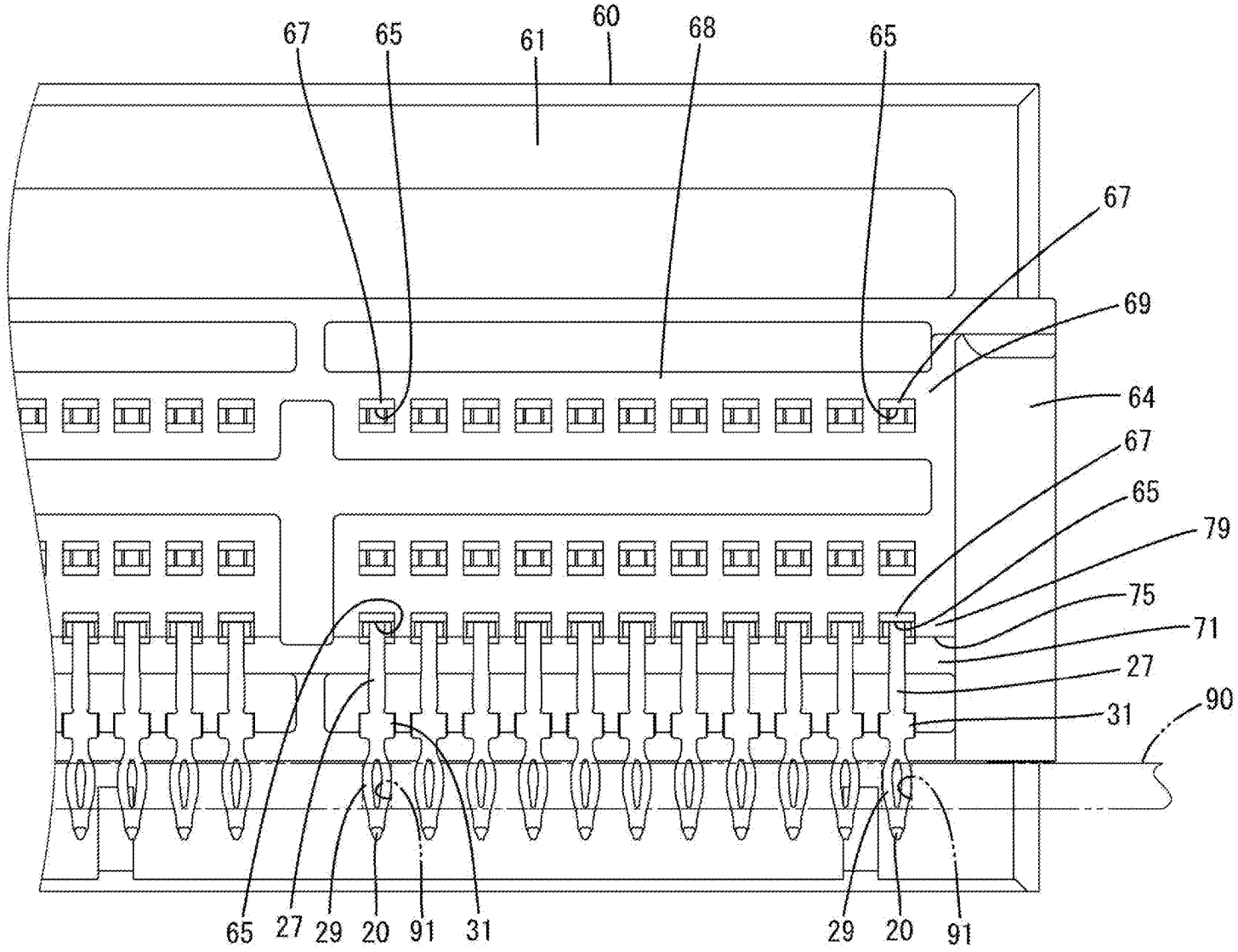
FIG. 4 is an enlarged back view showing a state where terminal fittings are mounted in press-fit holes in a lowermost stage of the housing.
Figure 5:
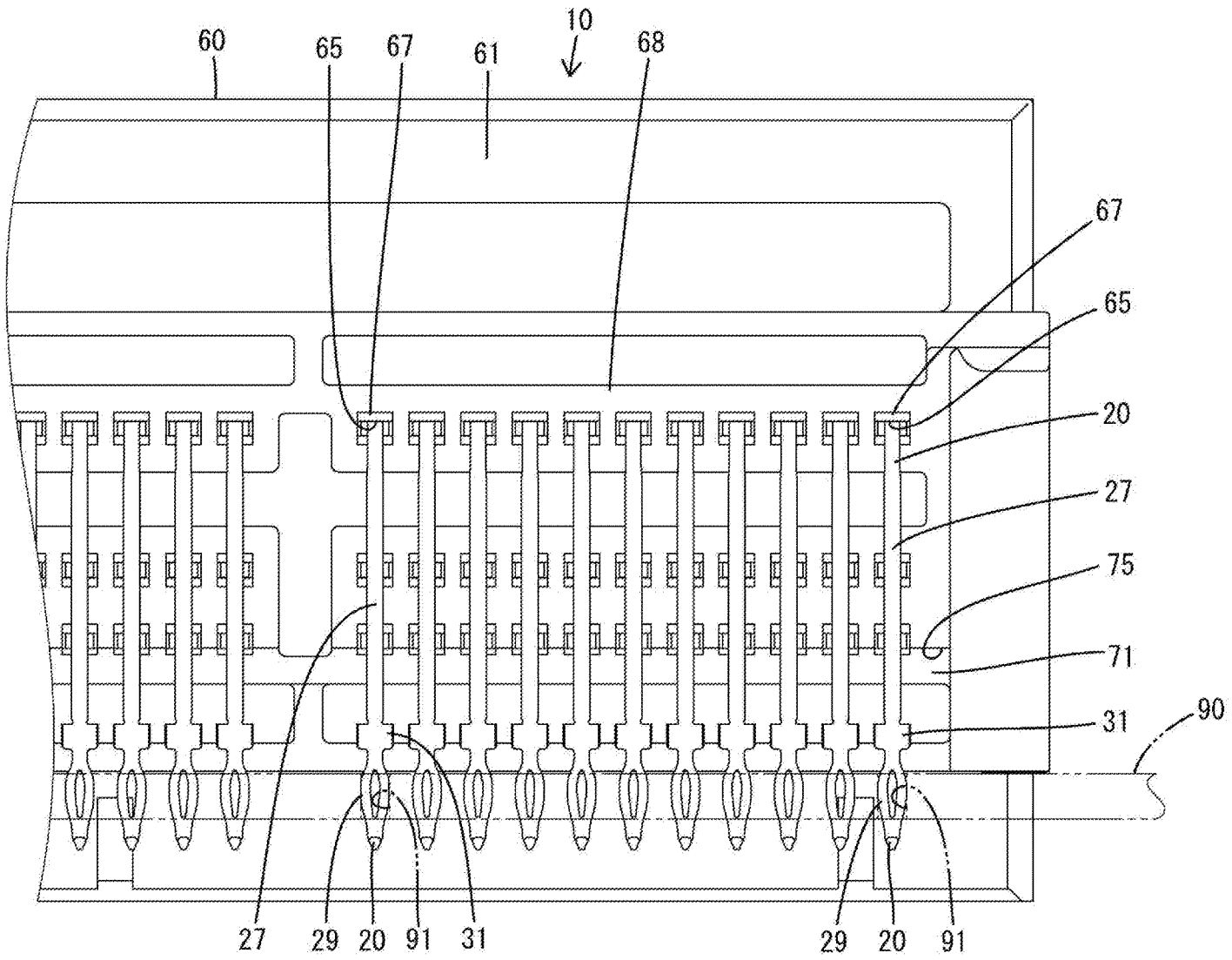
FIG. 5 is an enlarged back view showing a state where the terminal fittings are mounted in the respective press-fit holes of the housing.
Figure 6:
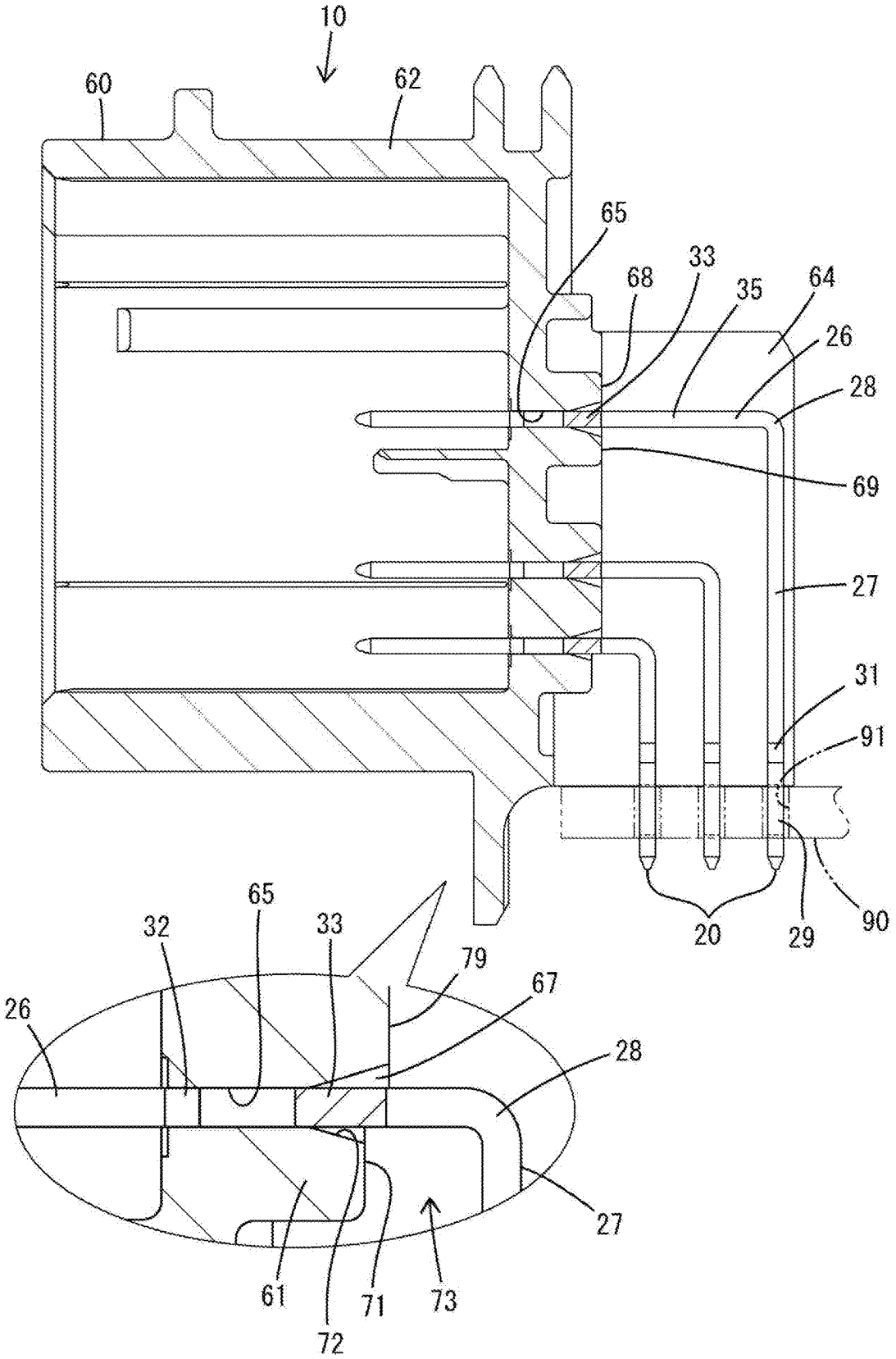
FIG. 6 is a side view in section of the board connector.

A first embodiment is described with reference to FIGS. 1 to 10. A board connector 10 of the first embodiment includes terminal fittings 20 and a housing 60 in which the terminal fittings 20 are to be mounted, as shown in FIG. 6. The housing 60 is to be fixed to an unillustrated case and connected to an unillustrated mating housing. Each terminal fitting 20 is connected to a circuit board 90 via a board connecting portion 27 to be described later in the case. Note that, in the following description, an end of the housing 60 facing the unillustrated mating housing at the start of connection is referred to as a front concerning a front-rear direction and a vertical direction is based on figures except FIGS. 8 and 9.

Figure 8:
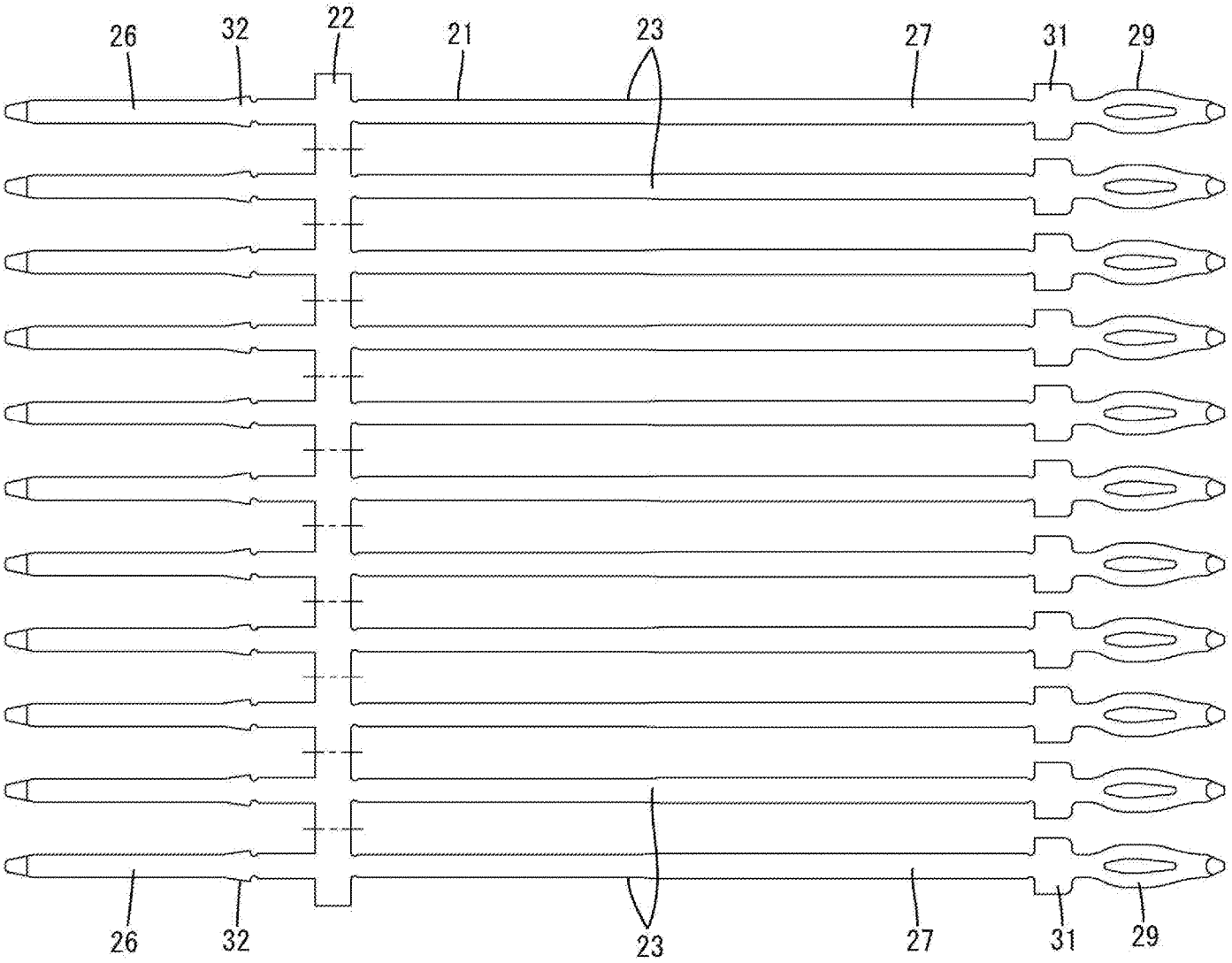
FIG. 8 is a plan view of chained terminals.
Figure 9:
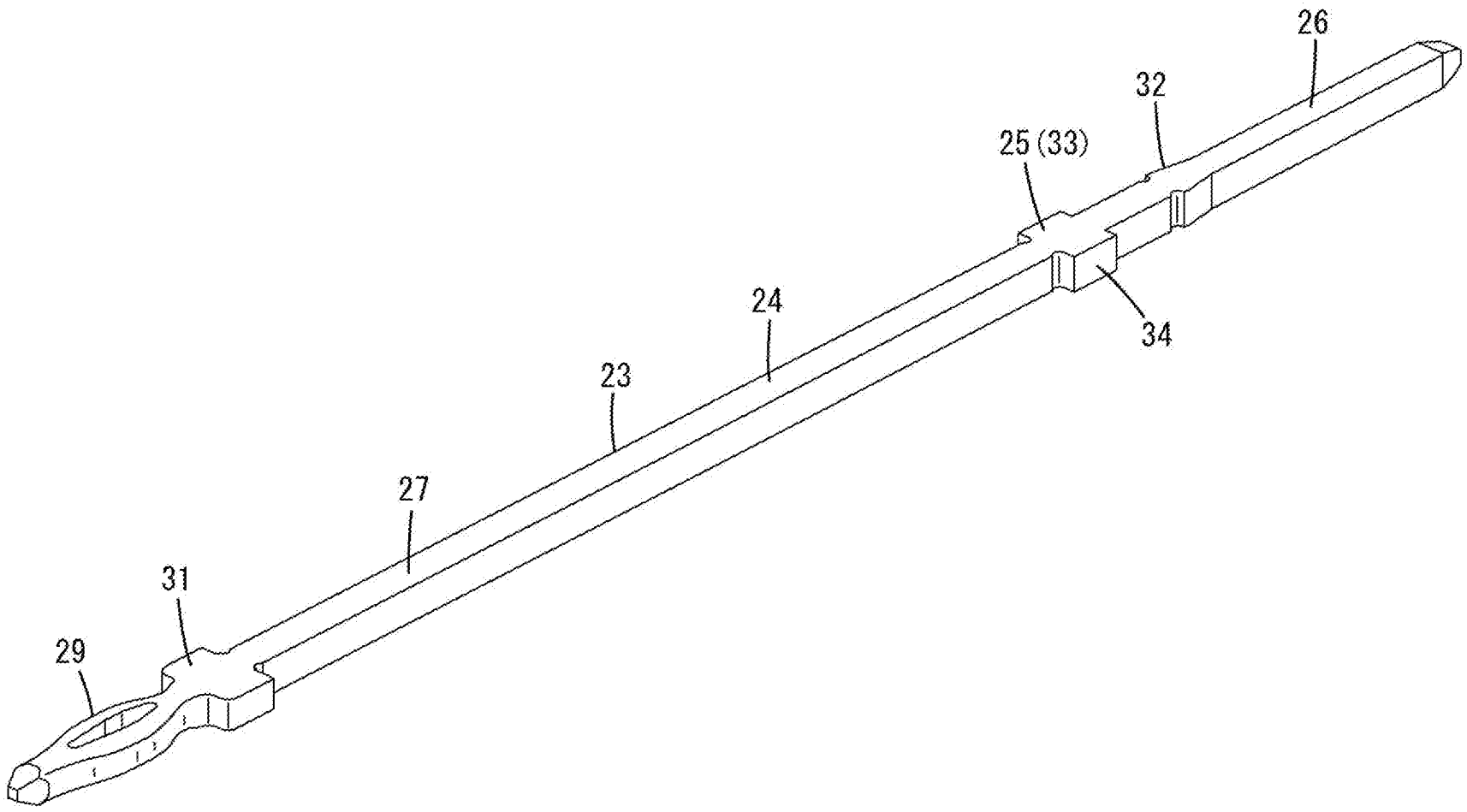
FIG. 9 is a perspective view of a terminal base member.

The terminal fittings 20 are manufactured from chained terminals 21 shown in FIG. 8. The chained terminals 21 are made of plated conductive metal and include terminal bases 23 arranged in parallel via a carrier 22. The terminal fitting 20 is formed by applying bending and the like to a single terminal base 23 obtained by cutting the carrier 22 along chain lines of FIG. 8 between adjacent terminal bases 23. The single terminal base 23 includes carrier remaining portions (protruding pieces 33) protruding toward both sides at an intermediate position of a straight portion 24 in a length direction, as shown in FIG. 9. Further, the terminal base 23 includes structural parts (locking pieces 32, protruding pieces 33) equivalent to a later-described mating side connecting portion 26 of the terminal fitting 20 and structural parts (press-fitting portion 29, projecting pieces 31) equivalent to the board connecting portion 27.

Figure 10:
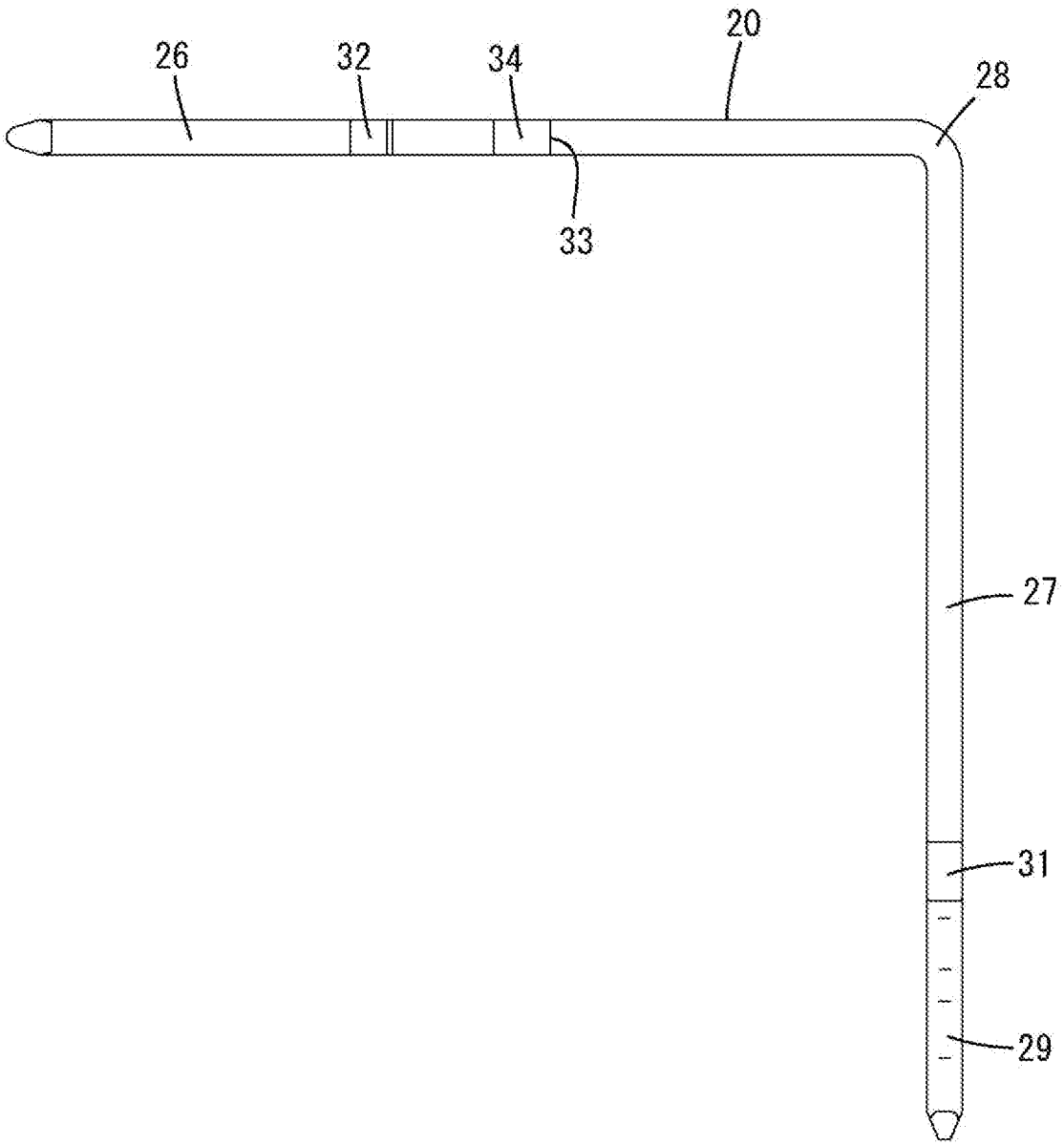
FIG. 10 is a side view of the terminal fitting.

The terminal fitting 20 is a pin having a substantially rectangular cross-section and formed into a substantially L shape in a side view, as shown in FIG. 10, by being bent substantially at a right angle at an intermediate position of the terminal base 23 in the length direction. Specifically, the terminal fitting 20 is composed of the mating side connecting portion 26 arranged substantially horizontally along the front-rear direction, the board connecting portion 27 arranged substantially along the vertical direction and a bent portion 28 between the board connecting portion 27 and the mating side connecting portion 26. The terminal fittings 20 are mounted in three stages in the vertical direction in the housing 60, as described later. Accordingly, the terminal fittings 20 are arranged more inwardly and formed to become gradually shorter in the order of the terminal fittings 20 in the upper stage, those in the middle stage and those in the lower stage.

The board connecting portion 27 extends down from the bent portion 28 and has the press-fit portion 29 on a lower end. As shown in FIGS. 4 and 5, the press-fit portion 29 has a flat shape bulging in a width direction and is deflectable and deformable in the width direction. The press-fit portion 29 is press-fit into a through hole 91 in the circuit board 90 and is connected electrically to a conductive part of the through hole 91. The board connecting portion 27 includes the projecting pieces 31 protruding toward both widthwise sides above the press-fit portion 29. The press-fit portion 29 is press-fit into the through hole 91 with an unillustrated press-fit tool held in contact with the projecting pieces 31.

The mating side connecting portion 26 extends forward from the bent portion 28 and includes claw-like locking pieces 32 protruding toward both widthwise sides at a position near a front end (see FIG. 9 although the terminal base 23 is shown). The locking pieces 32 bite into and lock with the inner surface of a later-described press-fit hole 65 of the housing 60. Further, the mating side connecting portion 26 includes the protruding pieces 33 protruding toward both widthwise sides behind the locking pieces 32. The protruding pieces 33 are rectangular plate pieces and equivalent to the carrier remaining portions 25 of the terminal base 23 and, as shown in FIG. 6, are accommodated in the press-fit hole 65 of the housing 60. Leading end surfaces in the width direction of the protruding pieces 33 are fracture surfaces 34 due to cutting from the carrier 22, and burrs are possibly formed on peripheral edges. As shown in FIG. 10, the bent portion 28 connects the board connecting portion 27 and the mating side connecting portion 26 substantially at a right angle and bent inner and outer surfaces have a substantially quarter-circular arc shape.

Figure 1:
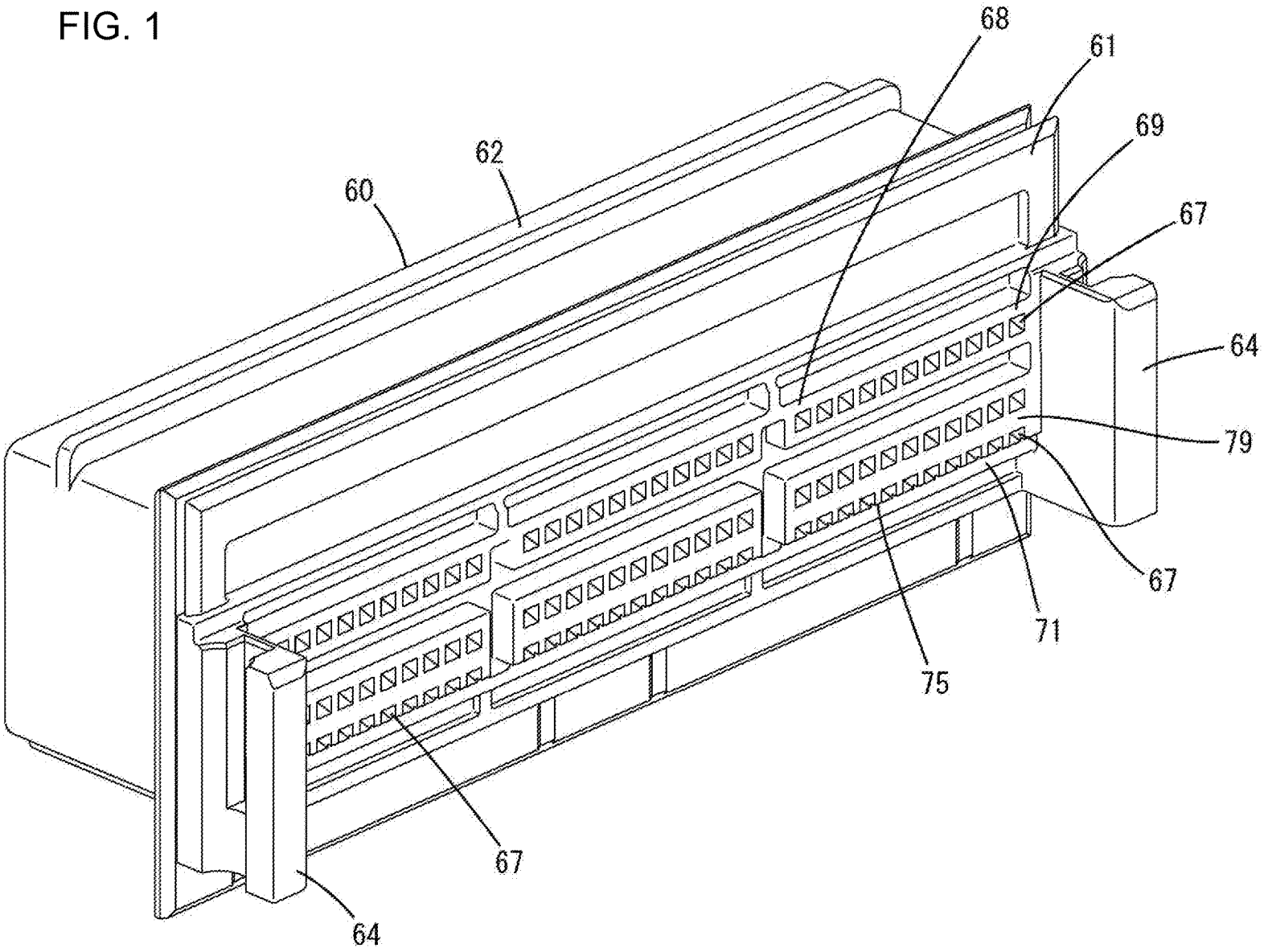
FIG. 1 is a perspective view of a housing in a board connector according to a first embodiment of the present invention.
Figure 3:
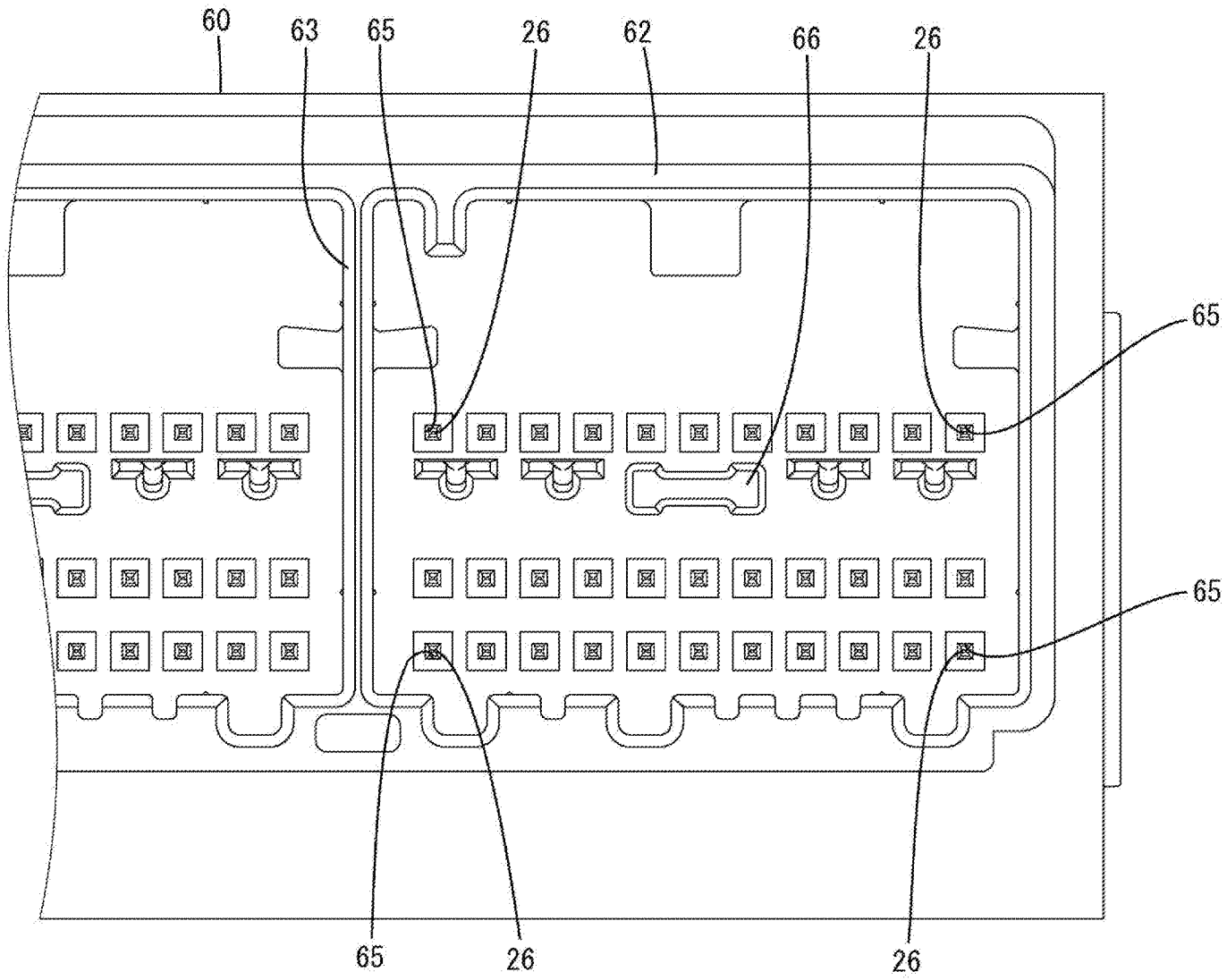
FIG. 3 is an enlarged front view of the board connector.

The housing 60 is made of synthetic resin and includes, as shown in FIG. 1, a substantially vertical back wall 61 defining a wide rectangle in a back view. A wide tubular receptacle 62 projects forward from the peripheral edge of the back wall 61. The receptacle 62 includes left and right separation walls 63 (the right one is shown in FIG. 3) inside and is divided laterally into three chambers (the right chamber and a part of the middle chamber are shown in FIG. 3) via the respective separation walls 63.

As shown in FIG. 1, the back wall 61 includes the protection walls 64 projecting rearward on both widthwise ends. The protection walls 64 are arranged to cover and protect exposed portions 35 of the respective terminal fittings 20 pulled out from a rear surface of the back wall 61, to be described later, from both widthwise sides.

Figure 2:
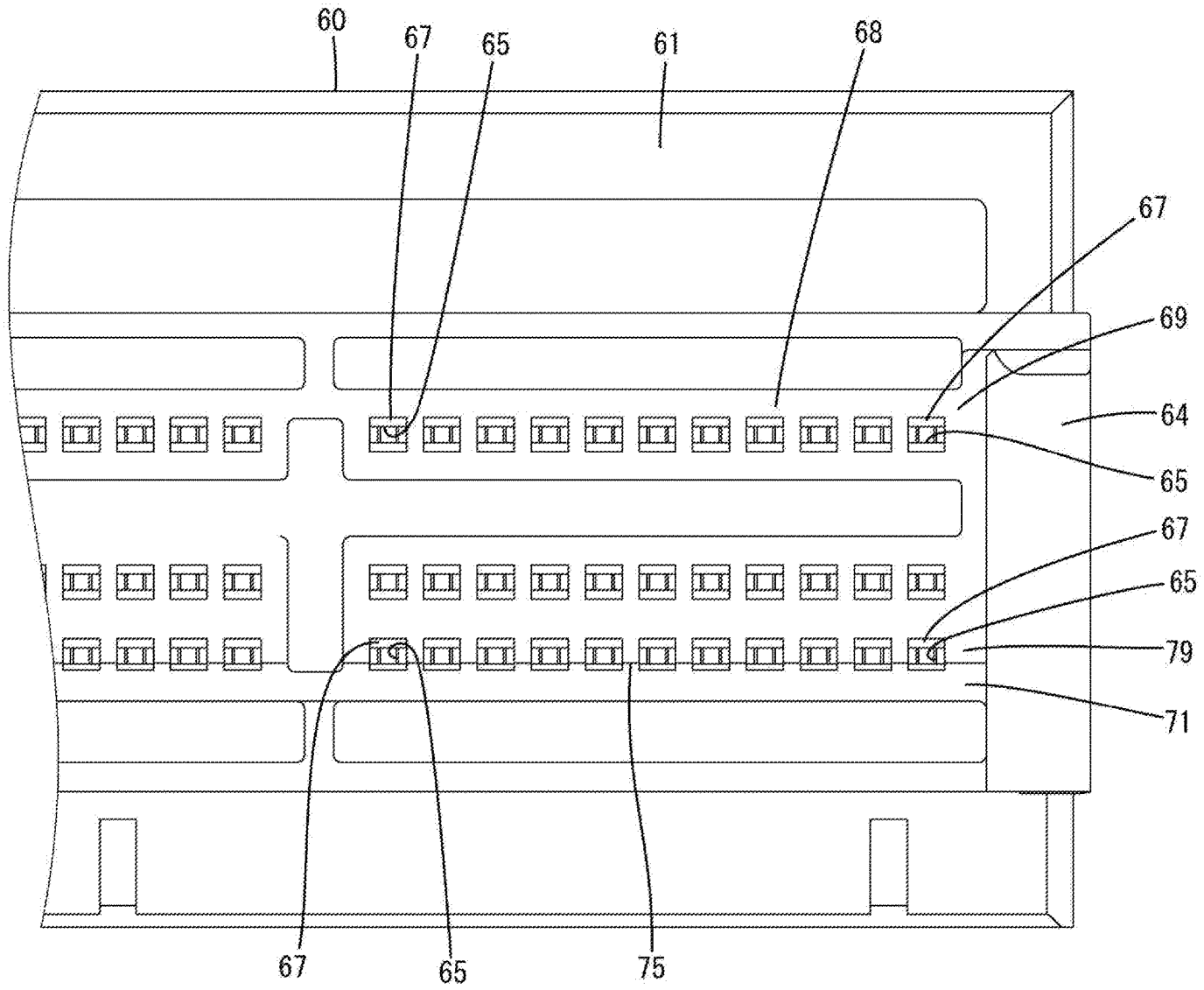
FIG. 2 is an enlarged back view of the housing.

Press-fit holes 65 penetrate the back wall 61 in the front-rear direction. As shown in FIGS. 2 and 3, a multitude of the press-fit holes 65 are arranged at intervals in the width direction in upper, middle and lower stages arranged in the vertical direction. The press-fit holes 65 are arranged in the same array in each of the three lateral chambers. As shown in FIG. 3, the back wall 61 has a pry connection preventing portion 66 for preventing pry connection of the board connector 10 by projecting forward between the press-fit holes 65 in the uppermost stage and those in the middle stage in each of the three lateral chambers.

Each press-fit hole 65 has a rectangular cross-section corresponding to the mating side connecting portion 26, as shown in FIG. 2, and upper and lower surfaces are arranged along the front-rear direction, as shown in FIG. 6. The back wall 61 includes guiding portions 67 widened toward a rear side from rear end openings of the respective press-fit holes 65 in the back surface 68.

The mating side connecting portion 26 of the terminal fitting 20 is press-fit into each press-fit hole 65 of the back wall 61 from behind and is held in the press-fit hole 65 by the locking action of the locking pieces 32. A front part of the mating side connecting portion 26 projecting into the receptacle 62 is connected electrically to an unillustrated mating terminal fitting mounted in the mating housing.

As shown in FIG. 6, a part of the terminal fitting 20 except a front part of the mating side connecting portion 26 serves as the exposed portion 35 pulled out rearwardly of the receptacle 62 and exposed. The exposed portion 35 of the terminal fitting 20 includes the bent portion 28 behind the press-fit hole 65 and the board connecting portion 27 at a position facing and at a distance from the back surface 68 of the back wall 61. The press-fit portion 29 of the board connecting portion 27 projects down from the lower surface of the receptacle 62 and is inserted into the through hole 91 of the circuit board 90 from above.

As shown in FIGS. 2 and 4, peripheral surfaces 69 are formed continuously around opening peripheral parts of the guiding portions 67 corresponding to the respective press-fit holes 65 in the back surface 68 of the back wall 61, except for the opening peripheral parts of the guiding portions 67 corresponding to the press-fit holes 65 in the stage closest to the circuit board 90. The peripheral surfaces 69 are flat and continuous over the entire periphery at the same position in the front-rear direction. As shown in FIG. 6, lower parts on a side close to the circuit board 90 of the opening peripheral parts of the guiding portions 67 corresponding to the respective press-fit holes 65 in the lowermost stage are retracted forward in a stepped manner with respect to upper parts on a side distant from the circuit board 90, and parts from the upper parts to both left and right parts are flat and continuous at the same position in the front-rear direction (partial peripheral surfaces 79).

The back surface 68 of the back wall 61 includes a retracted portion 71 at the press-fitting holes 65 in the lowermost stage. The retracted portion 71 is retracted in a direction separating from the facing board connecting portions 27 with respect to an upper part distant from the circuit board 90 in a lower part close to the board connector 90.

As shown in FIGS. 1 and 2, the retracted portion 71 is flat along the lateral and vertical directions. As shown in FIG. 6, the upper end of the retracted portion 71 is connected to lower slopes 72 of the guiding portions 67 of the press-fitting holes 65 in the lowermost stage and faces the respective press-fitting holes 65 in the lower stage by cutting rear parts of the lower slopes 72 of the guiding portions 67. The lower end of the retracted portion 71 is open in the lower surface of the back wall 61 and the left and right ends of the retracted portion 71 are respectively open in the left and right surfaces of the back wall 61. A tool installation space 74 into which a tool 50 (see FIG. 7) is to be installed is ensured behind the retracted portion 71 of the back wall 61 and between the retracted portion 71 and the board connecting portions 27 of the terminal fittings 20 facing the retracted portion 71.

As shown in FIGS. 1 and 2, the back surface 68 of the back wall 61 includes a step 75 arranged substantially horizontally along the front-rear direction between the retracted portion 71 and the peripheral surfaces 69 above the retracted portion 71 and continuous at the same height in the width direction in a back view. Similar to the retracted portion 71, the left and right ends of the step 75 are open in the left and right surfaces of the back wall 61. The step 75, which is the upper end of the retracted portion 71, is disposed at the same height as the lower surfaces of the press-fitting holes 65 in the lower stage in the vertical direction.

Next, an operation of assembling the terminal fittings 20 with the housing 60 and an assembling structure are described.

Figure 7:
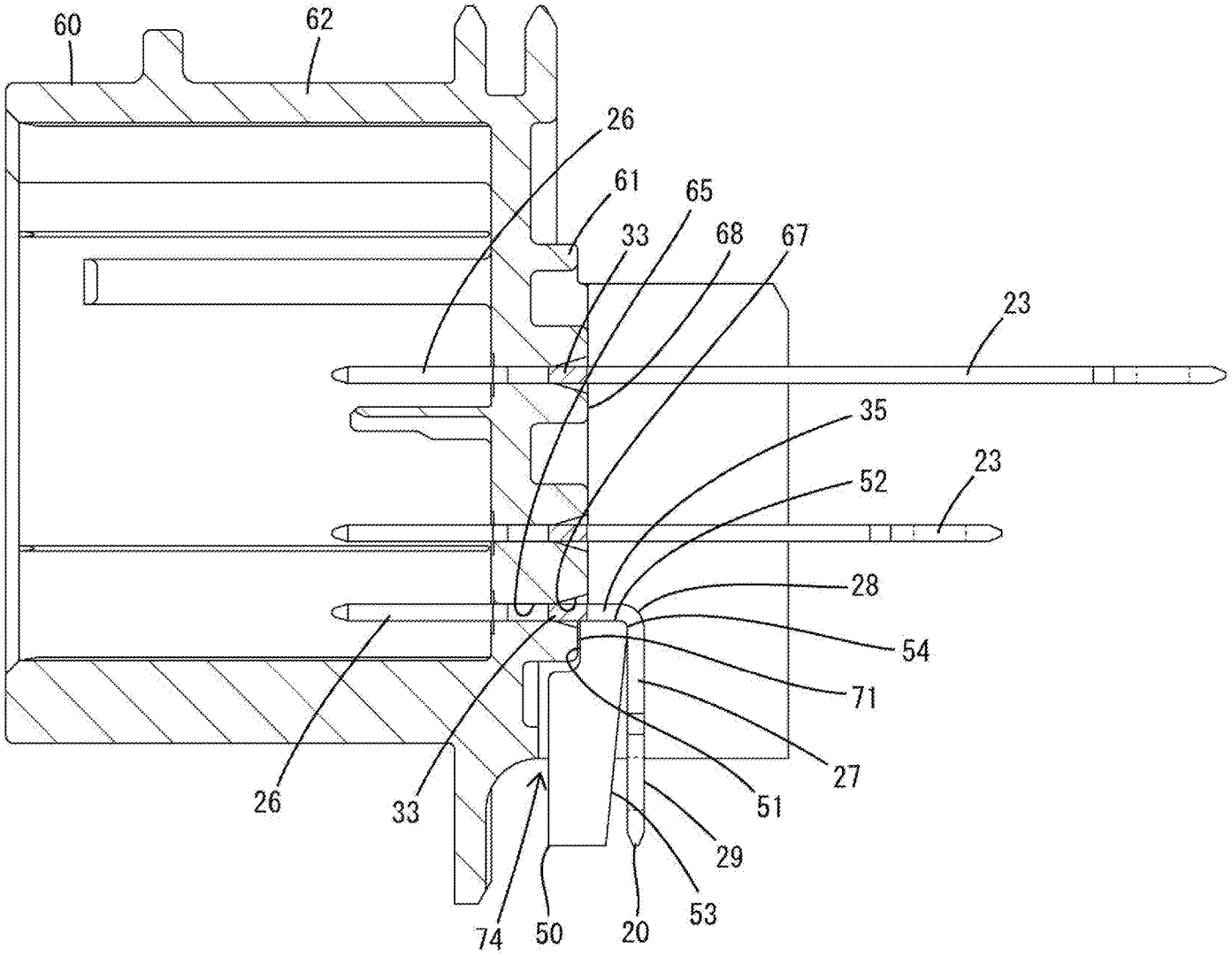
FIG. 7 is a side view in section showing a state where the terminal fittings in the lowermost stage are being bent.

In assembling, the straight terminal base 23 (terminal fitting 20 before bending) is press-fit into the press-fitting hole 65 of the back wall 61 from behind (see FIG. 7). At the start of press-fitting, the tip of the mating side connecting portion 26 of the terminal base member 23 is guided by the guiding portion 67 and inserted into the press-fitting hole 65. When the press-fitting is completed, the terminal base 23 is held in the press-fitting hole 65 by the locking action of the locking pieces 32. Further, the protruding pieces 33 of the terminal base 23 are accommodated from the press-fitting hole 65 to the guiding portion 67. Specifically, the terminal base 23 press-fit into each press-fitting hole 65 except the press-fitting holes 65 in the lowermost stage has the entire protruding pieces 33 accommodated inside both the press-fitting hole 65. Additionally, the guiding portion 67 and the terminal base member 23 press-fit in each press-fitting hole 65 in the lowermost stage has rear parts of the lower surfaces of the protruding pieces 33 exposed to a space below the step 75, but has the remaining parts including the fracture surfaces 34 arranged inside both the press-fitting hole 65 and the guiding portion 67 (see FIG. 6).

The terminal bases 23 then are bent to form the L-shape. To bend the terminal bases 23 press-fit in the press-fitting holes 65 in the lowermost stage, the tool 50 for bending shown in FIG. 7 is inserted into the tool installation space 74 and brought into contact with the retracted portion 71 of the back wall 61.

As shown in FIG. 7, the tool 50 includes a stepped recess 51 on a front end, a horizontal portion 52 extending along the front-rear direction on an upper end, a guide 53 inclined gradually forward toward a bottom from the bent portions 28 on a rear end and a top 54 having an acute angle between the guide 53 and the horizontal portion 52.

The stepped recess 51 is arranged to contact along the retracted portion 71 of the back wall 61, and the horizontal portion 52 is arranged to support the exposed portions 35 on rear parts of the mating side connecting portions 26. In that state, rear parts of the terminal bases 23 are bent toward the guide 53 with the top part 54 as a support. Thus, the bent portions 28 are formed along the top portion 54 and the board connecting portions 27 are formed along the guide 53. The board connecting portions 27 are bent at an acute angle with respect to the mating side connecting portions 26 in a state held in contact with the guide 53, but are displaced in a return direction to an upright vertical posture from the state held in contact with the guide 53 by resilient reaction forces acting with the bent portions 28 as supports.

For the terminal fittings 20 press-fit in the respective press-fitting holes 65 in the uppermost and middle stages except the press-fitting holes 65 in the lowermost stage, the terminal bases 23 can be bent using an unillustrated clamping tool such as pliers without utilizing the back surface 68 of the back wall 61, whereby the bent portions 28 and the board connecting portions 27 can be formed.

The board connecting portion 27 of each terminal fitting 20 is bent to extend down from the bent portion 28. Thereafter, the board connecting portion 27 of each terminal fitting 20 is inserted into the through hole 91 of the circuit board 90 from above and the press-fit portion 29 is brought into contact with the corresponding conductive part to be conductively connected.

As described above, according to the first embodiment, the back wall 61 of the housing 60 includes the retracted portion 71 in the back surface 68, thereby securing the tool installation space 74 between the retracted portion 71 and the board connecting portions 27 of the terminal fittings 20.

Thus, the terminal fittings 20 can be bent by installing the tool 50 into the tool installation space 74.

The retracted portion 71 is retracted forward in the direction separating from the board connecting portions 27 with respect to the partial peripheral surfaces 79 on the opposite side across the openings of the respective press-fitting holes 65 in the back surface 68 of the back wall 61. Thus, a length of the board connector 10 in the front-rear direction can be made shorter by that retracted amount and the board connector 10 is not enlarged. Further, since the retracted portion 71 is not formed in the respective press-fitting holes 65, but is shaped to cut the lower slopes 72 of the guiding portions 67 corresponding to the respective press-fitting holes 65 in the lowermost stage, contact margins between the back wall 61 of the housing 60 and the mating side connecting portions 26 of the terminal fittings 20 are not reduced and holding forces for the terminal fittings 20 can be ensured. Further, a guiding function of the guiding portion 67 corresponding to each press-fitting hole 65 in the lowermost stage can be exhibited without any trouble.

The protruding pieces 33 of each terminal fitting 20 are arranged inside both corresponding press-fit hole 65 and guiding portion 67. Thus, even if burrs are formed on the peripheral edges of the fracture surfaces 34, the burrs can be accommodated inside at least one of the press-fit hole 65 and the guiding portion 67, and the burrs will not drop onto the circuit board 90. As a result, a short circuit via burrs can be avoided.

Figure 11:
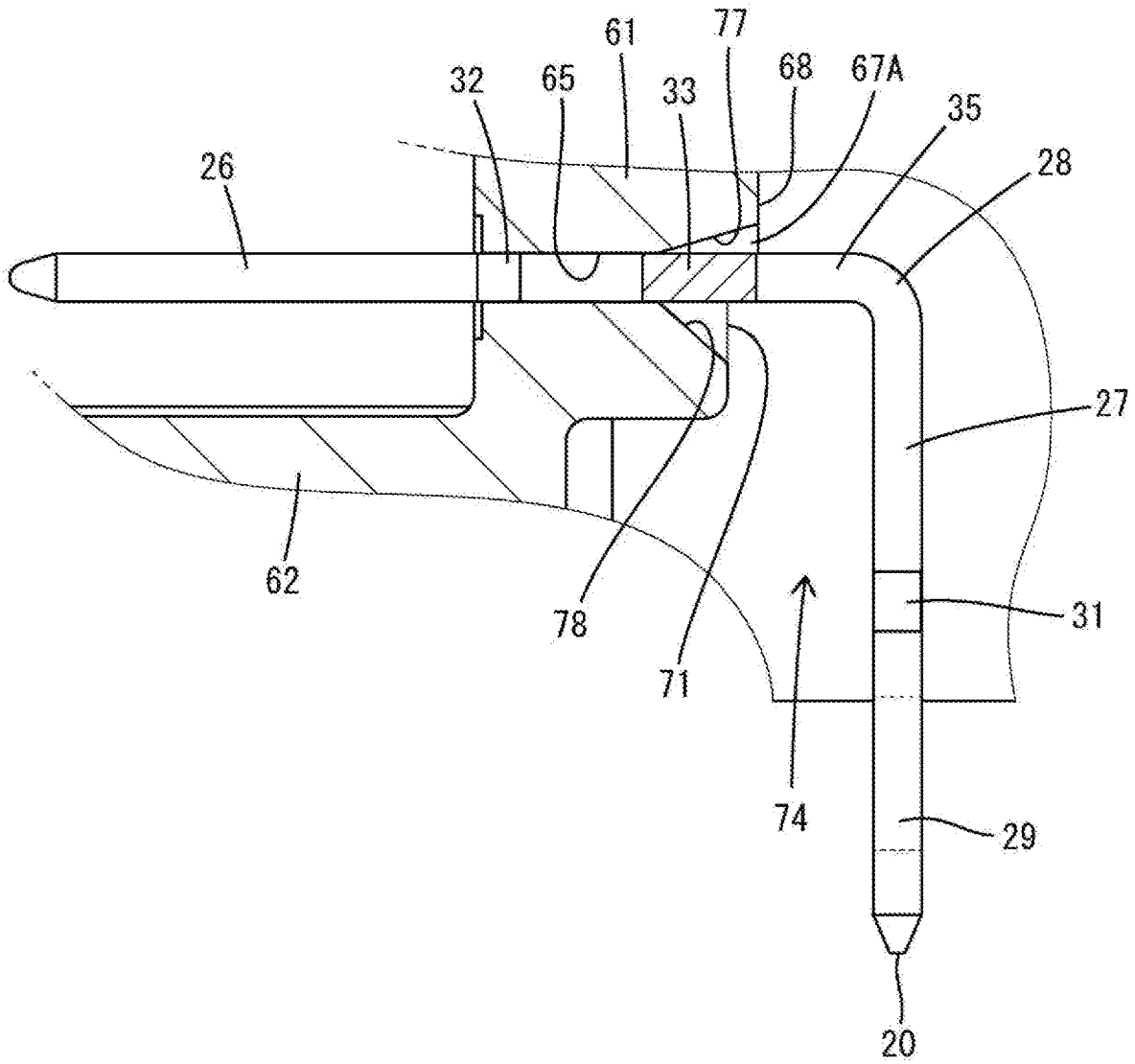
FIG. 11 is a partial enlarged side view in section of a board connector according to a second embodiment of the present invention.

FIG. 11 shows a second embodiment that differs from the first embodiment in the shape of guiding portions 67A corresponding to press-fit holes 65 in a lowermost stage. The other points are similar to the first embodiment and structures similar to the first embodiment are denoted by the same reference signs and are not described again.

In a back surface 68 of a back wall 61, a part close to a circuit board 90 serves as a steep slope 78 having a larger angle of inclination with respect to a front-rear direction (press-fitting direction of a mating side connecting portion 26) than an upper slope 77 (part distant from the circuit board 90). A retracted portion 71 is formed to cut the steep slopes 78 of the guiding portions 67A.

If the retracted portion 71 is formed to cut the guiding portions 67A, a guiding function of the guiding portions 67A may be reduced. However, in the second embodiment, the steep slopes 78 are expanded more than the upper slopes 77. Thus, a state where the mating side connecting portions 26 are picked up by the steep slopes 78 can be realized easily, and the reliability of the guiding function of the guiding portions 67A can be enhanced.

Other embodiments are briefly described below.

The retracted portion may be formed to partially cut the press-fit holes. In this case, since the parts opposite to the retracted portion across the openings of the press-fit holes can ensure sufficient contact margins with the mating side connecting portions in the back surface of the back wall, the holding forces for the terminal fittings can be ensured.

A clamping tool such as pliers may contact the back surface of the back wall and bend the terminal fittings press-fit in the press-fit holes in the lowermost stage.

The protruding pieces of the mating side connecting portion may be arranged only inside the press-fit hole. Alternatively, the protruding pieces of the mating side connecting portion may be arranged only inside the guiding portion.

The board connecting portion may be connected to the circuit board not by press-fitting, but by soldering.

LIST OF REFERENCE SIGNS

10 . . . board connector
20 . . . terminal fitting
26 . . . mating side connecting portion
27 . . . board connecting portion
28 . . . bent portion
33 . . . protruding piece
34 . . . fracture surface
60 . . . housing
61 . . . back wall
65 . . . press-fit hole
67, 67A . . . guiding portion
71 . . . retracted portion
90 . . . circuit board

What is claimed is:

1. A board connector, comprising: terminal fittings, each of which includes a mating side connecting portion to be connected to a mating terminal fitting, a board connecting portion to be connected to a circuit board and a bent portion arranged between the mating side connecting portion and the board connecting portion, the mating side connecting portion and the board connecting portion being connected substantially at a right angle via the bent portion; and a housing including a press-fit holes into which the mating side connecting portions are to be press-fit, and a back surface facing the board connecting portions;

the back surface of the housing includes a retracted portion retracted in a direction separating from the board connecting portion with respect to a distant side distant from the circuit board on a close side close to the circuit board to define a tool installation space to accommodate movement of a tool rearward of the back surface for bending the terminal fitting to form the bent portion and the board connecting portion.

2. The board connector of claim 1, wherein the press-fit holes are provided stages arranged in a vertical direction from a side distant from the circuit board to a side close to the circuit board in the housing, and the retracted portion is provided only in a part corresponding to the press-fit holes in a lowermost stage closest to the circuit board.

3. The board connector of claim 2, wherein the back surface of the housing includes an inclined guiding portion configured for guiding the mating side connecting portion on a peripheral part of the opening of the press-fit hole, and the retracted portion is shaped to cut an inclined part of the guiding portion.

4. The board connector of claim 3, wherein a part of the guiding portion on a side close to the circuit board with respect to the press-fit hole and provided with the retracted portion has a steep slope having a larger angle of inclination with respect to a press-fitting direction of the mating side connecting portion than a part on a side distant from the circuit board across the press-fit hole.

5. The board connector of claim 4, wherein the mating side connecting portion includes a protruding piece protruding to be lockable to an inner surface of the press-fit hole, a tip of the protruding piece is a fracture surface, and the protruding piece is located inside at least one of the press-fit hole and the guiding portion.

6. The board connector of claim 1, wherein the back surface of the housing includes an inclined guiding portion configured for guiding the mating side connecting portion on a peripheral part of the opening of the press-fit hole, and the retracted portion is shaped to cut an inclined part of the guiding portion.

7. The board connector of claim 6, wherein a part of the guiding portion on a side close to the circuit board with respect to the press-fit hole and provided with the retracted portion has a steep slope having a larger angle of inclination with respect to a press-fitting direction of the mating side connecting portion than a part on a side distant from the circuit board across the press-fit hole.

8. The board connector of claim 1, wherein the mating side connecting portion includes a protruding piece protruding to be lockable to an inner surface of the press-fit hole, a tip of the protruding piece is a fracture surface, and the protruding piece is located inside at least one of the press-fit hole and the guiding portion.

* * * * *